US007359770B2

(12) United States Patent
Cole

(10) Patent No.: US 7,359,770 B2
(45) Date of Patent: Apr. 15, 2008

(54) CONTROL SYSTEM FOR OPERATING LONG VEHICLES

(75) Inventor: Colin Cole, Rockhampton (AU)

(73) Assignees: Central Queensland University, Rockhampton (AU); Queensland Railways, Brisbane (AU)

( * ) Notice: Subject to any disclaimer, the term of this patent is extended or adjusted under 35 U.S.C. 154(b) by 203 days.

(21) Appl. No.: 10/840,435

(22) Filed: May 7, 2004

(65) Prior Publication Data

US 2004/0238693 A1 Dec. 2, 2004

(30) Foreign Application Priority Data

May 7, 2003 (AU) ..... 2003902168

(51) Int. Cl.
*G05D 1/00* (2006.01)
*G05D 3/00* (2006.01)
*B61L 15/00* (2006.01)

(52) U.S. Cl. ..... 701/19; 701/29; 701/98; 246/3; 246/4; 246/5; 246/6; 246/14; 246/15; 303/135

(58) Field of Classification Search ..... 701/19–20; 246/3–6, 14–15
See application file for complete search history.

(56) References Cited

U.S. PATENT DOCUMENTS 4,041,283 A * 8/1977 Mosier ..... 701/20
5,239,472 A * 8/1993 Long et al. ..... 701/20
5,424,948 A * 6/1995 Jordan, Jr. ..... 701/82
5,436,631 A * 7/1995 Magori et al. ..... 342/42
5,452,870 A * 9/1995 Heggestad ..... 246/182 R
5,758,848 A * 6/1998 Beule ..... 246/182 B
5,828,979 A * 10/1998 Polivka et al. ..... 701/117
5,922,034 A * 7/1999 Feely ..... 701/19
5,983,144 A * 11/1999 Bonissone et al. ..... 701/19
5,995,737 A * 11/1999 Bonissone et al. ..... 703/8
6,095,618 A * 8/2000 Heneka et al. ..... 303/3
6,125,311 A * 9/2000 Lo ..... 701/29
6,144,901 A * 11/2000 Nickles et al. ..... 701/19
6,243,694 B1 * 6/2001 Bonissone et al. ..... 706/4

(Continued)

FOREIGN PATENT DOCUMENTS

AU 2003902168 * 5/2003

(Continued)

OTHER PUBLICATIONS

"Genetic Algorithms for Automated Tuning of Fuzzy Controllers: A Transportation Application" by Piero P. Bonissone, et al, Fifth IEEE International Conference on Fuzzy Systems, Sep. 1996, New Orleans, LA, pp. 674-680.*

(Continued)

*Primary Examiner*—Cuong Nguyen
(74) *Attorney, Agent, or Firm*—Shoemaker and Mattare Ltd

(57) ABSTRACT

The present invention is directed to a system and method for optimizing the dynamics and energy usage of long vehicles such as freight trains by determining their operating conditions and calculating an optimal sequence of power and braking control actions. The sequence calculated provides for optimal vehicle dynamic behaviour with minimum energy usage in accordance with the train type, track topography and train operation rules and policies. The method and system serves as a management tool for the driver and reference signals for a train cruise control or autopilot system.

5 Claims, 7 Drawing Sheets

U.S. PATENT DOCUMENTS

| | | | | |
|---|---|---|---|---|
| 6,263,266 | B1 * | 7/2001 | Hawthorne | 701/19 |
| 6,580,976 | B1 * | 6/2003 | Belcea | 701/20 |
| 6,587,764 | B2 * | 7/2003 | Nickles et al. | 701/19 |
| 6,622,068 | B2 * | 9/2003 | Hawthorne | 701/19 |
| 6,668,201 | B1 * | 12/2003 | Bonissone et al. | 700/50 |
| 6,760,712 | B1 * | 7/2004 | Bonissone et al. | 706/4 |
| 6,862,502 | B2 * | 3/2005 | Peltz et al. | 701/19 |
| 7,302,895 | B2 * | 12/2007 | Kumar et al. | 105/26.05 |
| 2001/0029411 | A1 * | 10/2001 | Hawthorne | 701/19 |
| 2003/0105561 | A1 * | 6/2003 | Nickles et al. | 701/19 |
| 2004/0238693 | A1 * | 12/2004 | Cole | 246/3 |

FOREIGN PATENT DOCUMENTS

JP 58075410 A * 5/1983

OTHER PUBLICATIONS

"Automated Fuzzy Knowledge Base Generation and Tuning" by DG Burkhardt, et al, 1992 IEEE, San Diego, CA, pp. 179-188. "A Classified Review on the Combination Fuzzy Logic-Genetic Algorithms Bibliography" by O. Cordon, et al, Research Report DESCAI95129, Dept. of Computer Science and AI, Universidad de Granada, Granada, Spain, 1995, 21 pages.*

"Tuning Fuzzy Logic Controllers by Genetic Algorithms" by F. Herrera, et al, Int. Journal Approximate Reasoning (IJAR), vol. 12, Nos. 3/4, Apr./May 1995, pp. 299-315.*

"Integrating Design States of Fuzzy Systems Using Genetic Algorithms", by MA Lee, et al, IEEE Trans. on Systems, Man and Cybernetics, vol. SMC-15, No. 1, 1985, pp. 116-132.*

"A Practical Guide to Tune of Proportional and Integral (PI) Like Fuzzy Controllers" by L. Zeng, 1992 IEEE Conference on Fuzzy Systems, San Diego, CA, pp. 633-640.*

"Design of an Adaptive Fuzzy Logic Controller Using a Genetic Algorithm" by CL Karr, In Proc Int. Conf on Genetic Algorithms (ICGA '91), vol. 1, pp. 450-456, San Diego, CA 1991.*

"Integrating Design States of Fuzzy Systems Using Genetic Algorithms", by MA Lee, et al, IEEE Conference on Fuzzy Systems, vol. 1, 1993, San Francisco, CA, pp. 612-617.*

"A Classified Review on the Combination Fuzzy Logic-Genetic Algorithms Bibliography" by O. Cordon, et al, Research Report DESCAI95129, Dept. of Computer Science and AI, Universidad de Granada, Granada, Spain, 1995, 21 pages.*

* cited by examiner

CONTROL SYSTEM FOR OPERATING LONG VEHICLES

FIELD OF INVENTION

The present invention relates to control systems in long vehicles for operating with optimal vehicle dynamics and energy consumption. The present invention has particular but not exclusive application for freight trains, passenger trains and road trains. By way of example only the specification refers to trains and in particular to freight trains.

BACKGROUND

Automatic control systems have been developed for automobiles, aircraft, ships and even some passenger trains. The development of automatic control systems for freight trains has encountered a number of problems arising from characteristics specifically associated with freight trains. Freight trains can be very long and the train may be subject to several different conditions of grade, curvature, speed restriction and aerodynamic drag along its length. As well the driver cannot be expected to remain cognisant of all these conditions. Another problem is that the train can be configured with at least as many different load mix configurations as the number of rail wagons. Load configurations change the dynamic characteristics of the train and therefore change the requirements for driving practice or train control.

One possible solution is to modify braking and couplings to improve the dynamic behaviour of trains. However most freight train operators usually have a large rolling stock base and modifying each of the train vehicles would introduce compatibility and logistic problems and require considerable expenditure. For these reasons extensive modification of rolling stock is generally resisted by freight train operators.

Another approach has been the development of control systems for trains such as those disclosed in Japanese patent 58075410 and U.S. Pat. No. 5,239,472. These systems are primarily concerned with minimizing energy usage and compliance with speed restrictions and signals. These control systems however are limited to suburban passenger trains rather than long freight trains. These systems do not take into account the variability of loading and length that characterizes freight trains.

A system that determines the train and track conditions and processes the information in conjunction with train restraint conditions and optimal operating parameters to provide optimum driving parameters is disclosed in U.S. Pat. No. 6,144,901. While considering a number of parameters the system described in U.S. Pat. No. 6,144,901 does not address all the particular characteristics of long freight trains as discussed above.

SUMMARY OF THE INVENTION

It is an object of the present invention to provide a control system for operating freight trains.

In one aspect the present invention broadly resides in a control system for controlling the dynamics and energy consumption of long vehicles during operation including computer means adapted to receive and process signals from input means to produce an operating parameter signal; and control means for receiving and responding to said operating parameter signal; wherein the processing of the input signals involves algorithmic analysis of the signals weighted in response to present and future grade forces and speed requirements to produce an initial operating signal, analysis of the input signals weighted in response to present and future track curvature and speed requirements and combining the results of both analyses to produce said operating parameter signal.

The input means includes transducer inputs from proximal and remotely positioned driving units such as locomotives, inputs from global positioning system (GPS) providing position information, telemetry inputs providing current and future signals, inputs from track information database providing information about the track under and ahead of the vehicle.

The control means includes transducer inputs for brake and throttle control for the proximal and remotely positioned driving units.

The operating parameter signal is preferably displayed as driver advice on the driver control panel, input for operation of a cruise control, or input for operation of an autopilot. In another embodiment the operating parameter signal may be displayed as input for operation of simulation software.

In one preferred embodiment the control system includes a further signal processing step of analyzing the input signals in response to where along the vehicle's length to apply power during the operation of the vehicle to produce a result that is further combined with the results of the first two steps to produce an operating parameter signal.

In another aspect the invention broadly resides in a method of producing an operating parameter signal for the control of a long vehicle during operation including receiving input signals from input means;

processing input signals using algorithmic analysis weighted in response to present and future grade forces and speed requirements, processing input signals using algorithmic analysis weighted in response to present and future track curvature and speed requirements, combining the results of the processes to produce an operating parameter signal.

The operating parameter signal is receivable and capable of being responded to by said control means.

The method is preferably used in the aforementioned system for operational control of long vehicles such as freight trains, passenger trains and road trains.

The processing of the input signals preferably includes three distinct layers of analysis and processing the results of the analysis to produce the response wherein the first layer analyses the input signals in relation to set values for grade topography and velocity, the second layer analyses the input signals in relation to set values for speed limitations and the third layer analyses the combined output of the first and second layers in relation to set values for distributed power optimization to produce the response for vehicle control.

In a further aspect the invention broadly resides in a method of producing a response for vehicle control including processing of input signals with three distinct layers of analysis and processing the results of the analysis to produce the response wherein the first layer analyses the input signals in relation to set values for grade topography and velocity, the second layer analyses the input signals in relation to set values for speed limitations and the third layer analyses the combined output of the first and second layers in relation to set values for distributed power optimization to produce the response for vehicle control.

Additional forms of analysis may be added including analyzing processed outputs through driving rule filters, special braking rule filters, power restriction filters and track database information.

BRIEF DESCRIPTION OF THE DRAWINGS AND TABLES

In order that the present invention be more readily understood and put into practical effect, reference will now be made to the accompanying drawings wherein.

Figure 4:
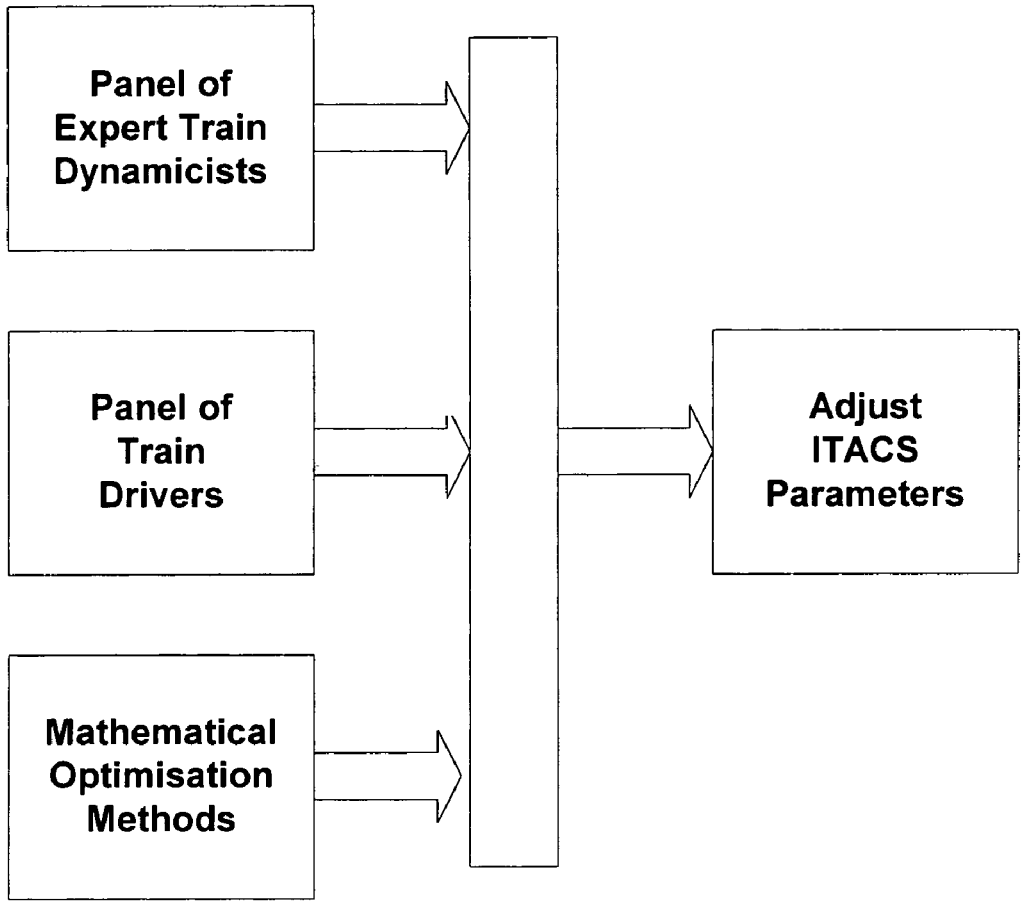
Figure 5:
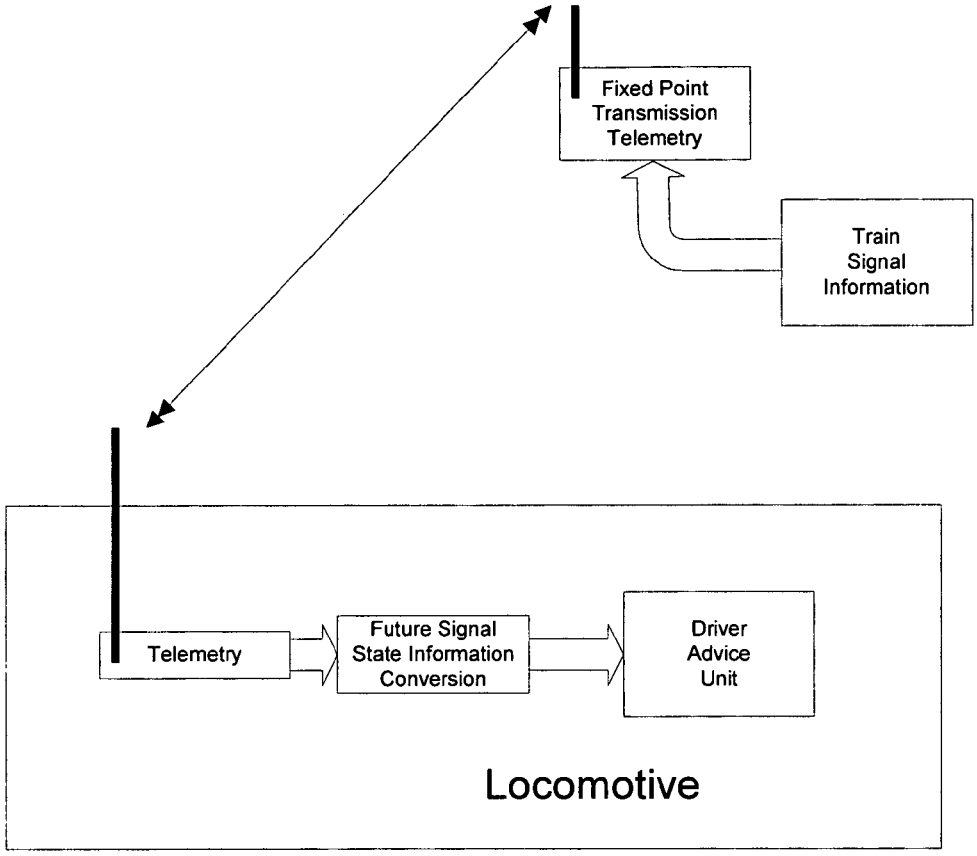
Figure 6:
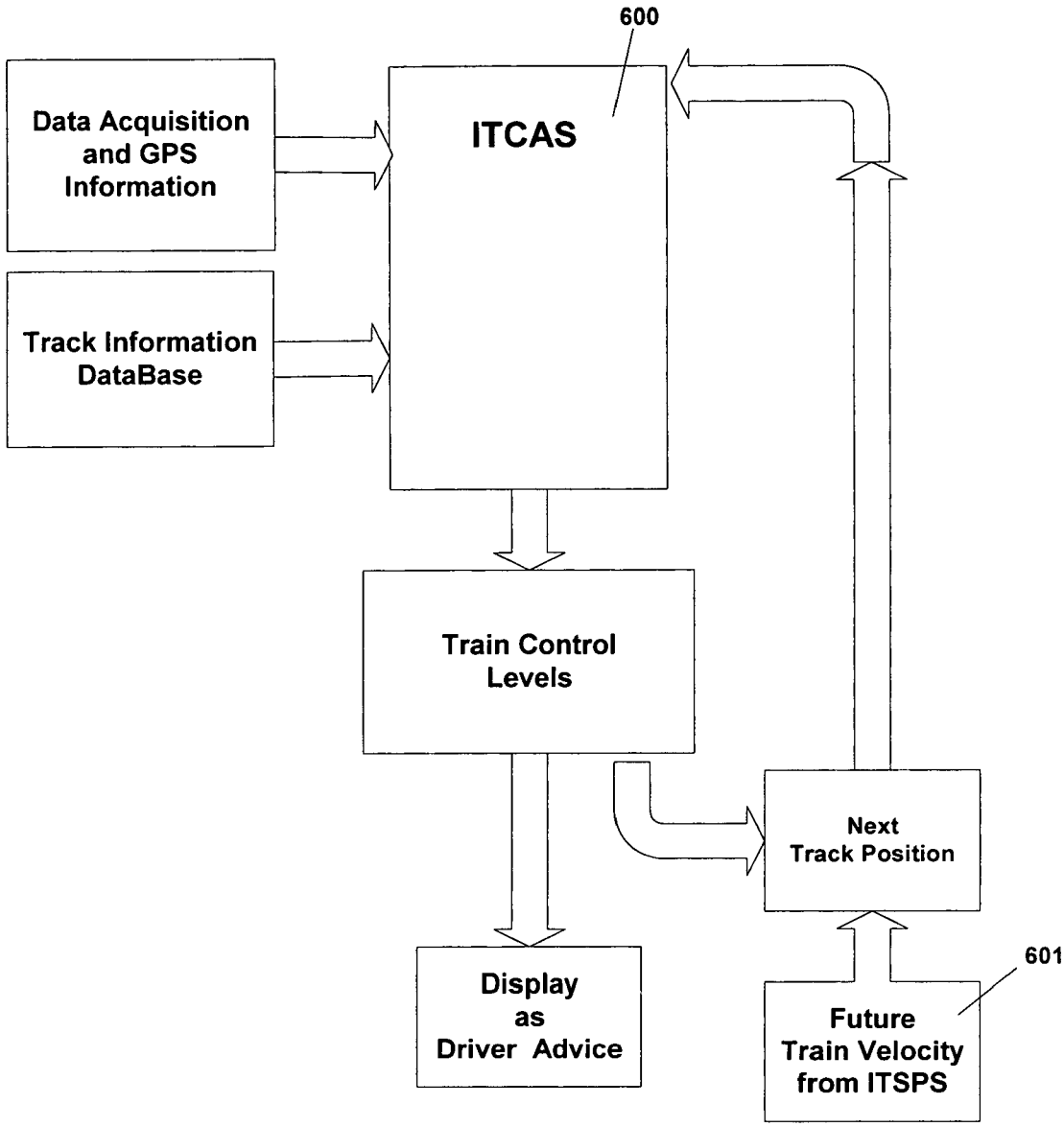
Figure 7:
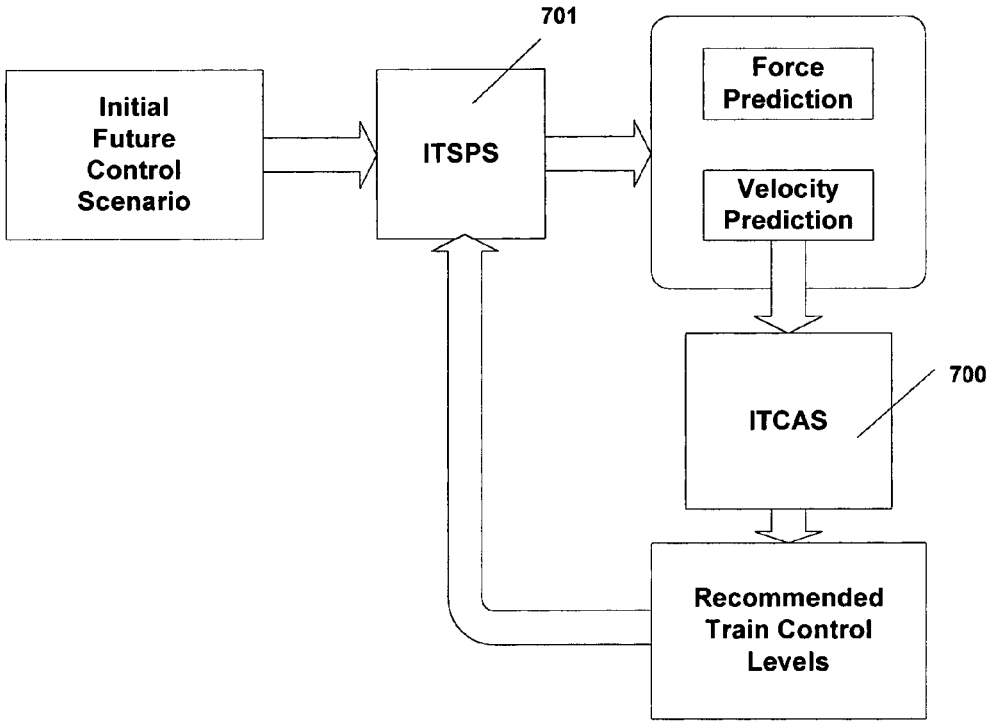

FIG. 4 diagrammatically shows the options available for adjusting control system parameters;

FIG. 5 diagrammatically shows a method that could be used to add distance-to-go signaling information to the control system;

FIG. 6 diagrammatically shows how the ITCAS can be implemented with the ITSPS to provide control action advice for the future time period; and FIG. 7 shows how the output from the ITCAS can be used to obtain predictions of in-train forces from the ITSPS.

Table 1 shows the fuzzy rules for grade-speed cruise control module;

Table 2 shows example values for the fuzzy rules for grade-speed cruise control module;

Table 3 shows the fuzzy rules for speed restriction cruise control module;

Table 4 shows example values for the fuzzy rules for speed restriction cruise control module;

Table 5 shows the fuzzy rules for traction splitting for distributed power trains;

Table 6 shows the fuzzy rules for retardation splitting for distributed power trains;

Table 7 shows example values for the fuzzy rules for traction splitting for distributed power trains;

Table 8 shows example values for the fuzzy rules for retardation splitting for distributed power trains; and Table 9 shows an example of train trip performance cost function optimization weights.

DESCRIPTION OF THE PREFERRED EMBODIMENTS

Figure 1:
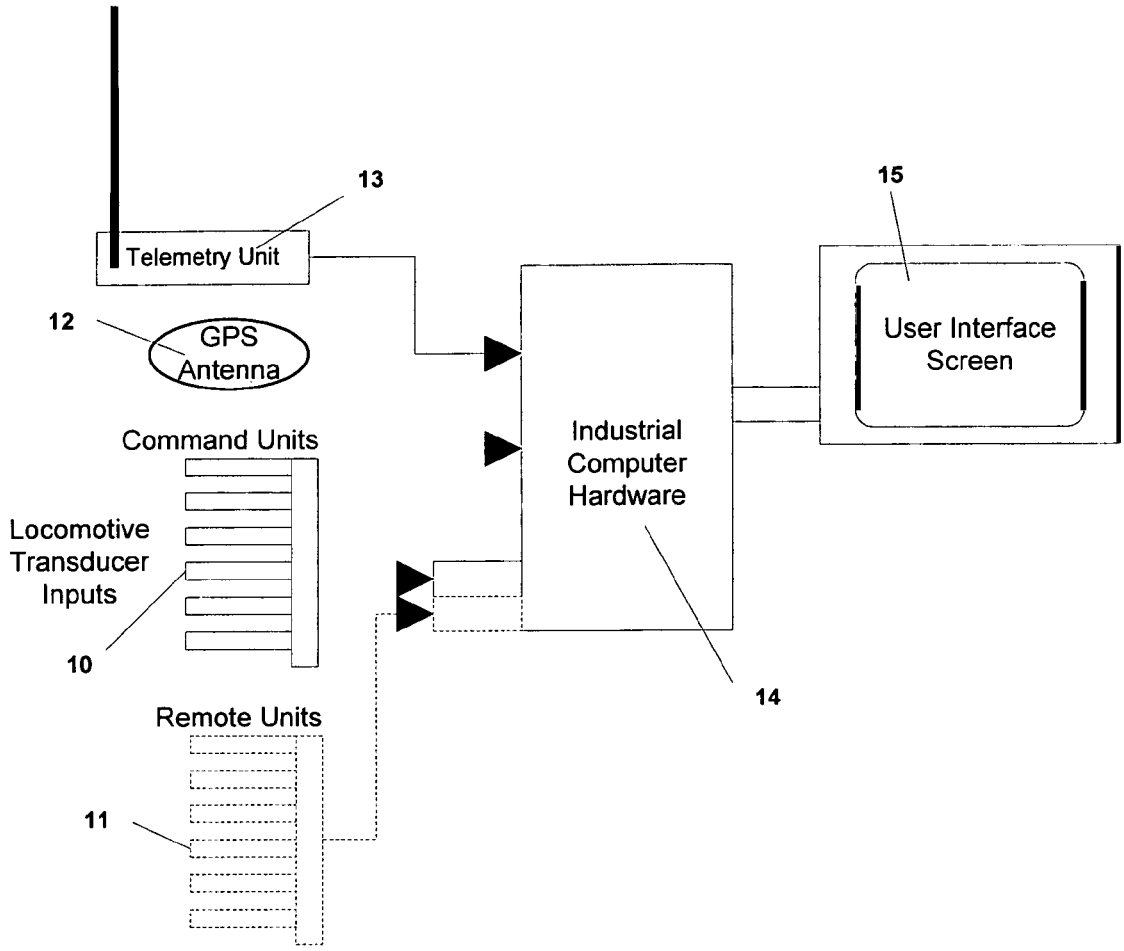
FIG. 1 is a diagrammatic representation that shows a preferred embodiment of the train control system of the present invention.
Figure 2:
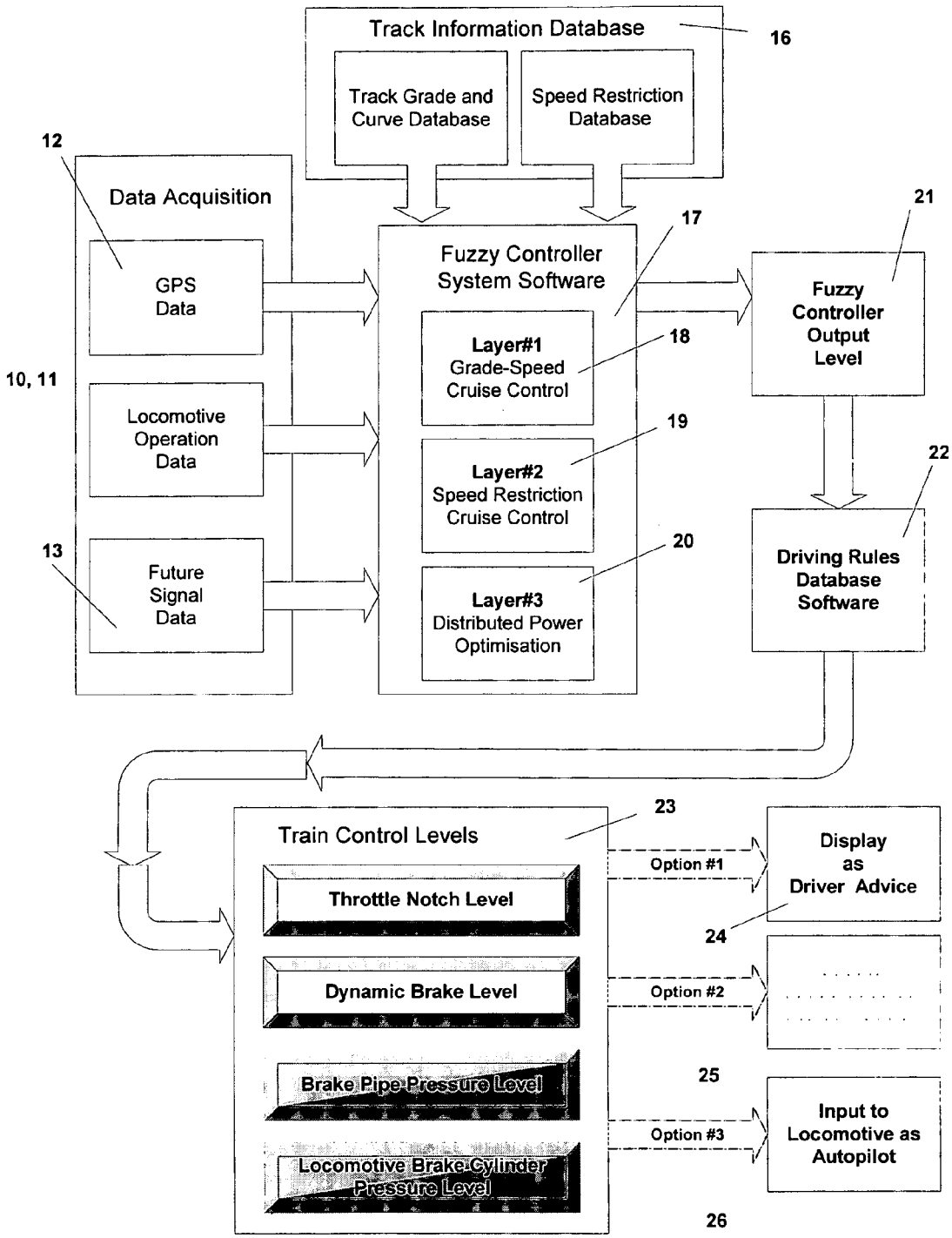
FIG. 2 is a flow diagram showing three alternative preferred embodiments of the control system for trains, providing either driver advice, cruise control or autopilot.

The preferred embodiment of the invention is in relation to freight trains. The preferred embodiment will be hereinafter referred to as the Intelligent Train Control Advisor System (ITCAS). The inputs to one form of ITCAS is shown in FIG. 1 while a generalized flow chart of ITCAS is shown in FIG. 2. With reference to FIG. 1, there is shown locomotive transducer inputs 10, remote (locomotive) inputs 11, GPS inputs 12 and a telemetry link 13 which provides signal information to the computer processing unit 14 for signal processing and production of an operating parameter signal. The computer processing unit 14 uses fuzzy logic controller software 17 (FIG. 2) to provide control levels for vehicle power and braking settings. The control levels produced can be either displayed to the driver 15 or used as inputs to cruise control or autopilot systems or used in a application to control train simulation.

With particular reference to FIG. 2, data obtained from inputs 10,11,12, and 13 is combined with the track information database 16 to establish the grade, curve and speed restriction information relevant to the train. The information encompasses the track area under the train and the track area about to be occupied by the train. The methods used to transfer signal information to the locomotive will vary depending on the signaling infrastructure available. FIG. 5 shows a schematic of a system that could be implemented with centralized train signal control.

The fuzzy logic control software 17 has three layers of analysis that are calculated and combined. Layer 1 is a grade topography cruise control 18. This layer returns a number between −1.0 and 1.0 that is proportional to the present and future grade forces and the running speed requirement. Several fuzzy interpolation systems are used with structures as shown in Table 1. Each fuzzy interpolator refers to a section of track either in front of or underneath the train. The fuzzy system software calculates the power and braking requirements for each section of track. The outputs are then combined to give optimal control levels for the operation of the train for its present location, speed and operational constraints.

The cruise control system operates according to the following sequence. The cruise control system applies fuzzy rule sets as detailed in Table 1 to changes in gravitational potential energy, represented mathematically as grades, in four or more distinct track zones in front of, and underneath, the train. A four zone track system comprising track in the far future zone (zone 1), track in the future zone (zone 2); track under the first half of the train (zone 3); and track under the second half of the train (zone 4). The track zones 1 and 2 are estimated in terms of train running time. Additional track zones can be added comprising future track sections. For example if 5 zones were used then three would be used as future zones instead of two. A running time is user selected and multiplied by the actual running speed to give a track length. The track length of the future zones will therefore be proportional to running speed. The second two track zones 3 and 4 are under the train and are determined by train length. The net grade on the track length in each track zone is calculated and is used as an input to the fuzzy rule set. The second input to the fuzzy rule set is the velocity error which is difference between the actual running speed and desired or target running speed. The target speed is subtracted from the actual running speed to give negative values for under speed and positive values for overspeed. The fuzzy rule set as given in Table 1 gives a fuzzy rule set output value (frsov) between −1 and 1 for each combination of track grade and velocity error. Four values of frsov are calculated, one for each track zone. A typical example of values in Table 2. Referring to Table 2, the combination of a steep downgrade (−1.0%) with underspeed (i.e. −10 kph) results in a zero output, it is expected that the grade will accelerate the train. Conversely, a steep upgrade, (1.0%) plus an underspeed, (−10 kph) results in a full power request, (e=1.0.).

Outputs for all four (or more) track zones are combined using either the largest value, (Winner takes all), obtained or a weighted combination following the formula:

$$\text{Output}=(w1*frsov1+w2*frsov2+w3*frsov3+w4*frsov4)/(w1+w2+w3+w4)$$

Where w1, w2, w3, w4 are user selected weights and frsov1, frsov2, frsov3, frsov4 are outputs from each fuzzy rule set, (frsov=fuzzy rule set output value).

The fuzzy system provides the mechanism to interpolate between values and sets values at limiting levels for conditions outside the fuzzy rule set, (Table 2). For example a steep down grade of. (−1.0%) with underspeed (i.e. −15 kph) would result in an output of 0.1. A steeper grade of −1.5% would not result in lower power application levels. It is therefore important that the fuzzy rule set be inclusive of all track and operating conditions that the train will encounter.

Similarly layer 2 is a speed restriction enforcer 19 that returns values between −2.0 and 0.0. The value is set by the deceleration required at the present and future train positions. The inputs to the speed restriction enforcer module 19 includes the train velocity and the value and positions of speed restrictions and signals in the train area. Again several fuzzy interpolators such as shown in Tables 3 and 4 are used. If there is no need for the train to decelerate this module returns a value of zero. Extreme need to decelerate returns a −2.0.

The speed restriction enforcer 19 operates according to the following sequence. Using a similar methodology to the cruise control 18, the speed restriction module 19 also requires the examination of track zones in front of and underneath the train. For this module, three zones are used, namely track in the far future zone (Zone 1), track in the future zone (Zone 2), and track under the train (Zone 3).

The zones are again set using the running time values to set the track length to be considered. The distance to the speed restriction in that zone is then calculated. The highest speed restriction is defined as the one requiring the greatest deceleration. This distance is provided as an input to the fuzzy set. The distance for speed restrictions on the track under the train are taken as zero regardless of where they occur. The second variable to the fuzzy rule set is the required velocity reduction. The velocity reduction required is defined as the actual speed subtracted from the speed target. An example of typical values are shown in Table 4. This fuzzy rule set works in exactly the same way as the cruise control rule set and is evaluated three times to get frsov1, frsov2, frsov3. In this case results are combined on a winner-take-all basis only so that only maximum braking requirements are registered. The most negative value is taken as the output of the system.

The value from the Layer 1 system (i.e. Table 2) is simply added to the value from the Layer 2 system(i.e. Table 4). The need to slow and stop the train, registered by a value of −2.0 will completely override the grade topography cruise control even if it shows a requirement for maximum power of 1.0. If the result is less than −1, then the value is limited to −1 corresponding to full retardation.

Layer 3 is a throttle/braking splitter 20 for application of different amounts of power and braking to command and remote locomotives in distributed power trains. This module acts as a filter on the combined output of layers 1 and 2. The split of either traction or braking forces required is determined by one of the two sets of fuzzy rules as shown in Tables 5 and 6 with example values in Tables 7 and 8. A different fuzzy set is applied depending on the requirement for either traction or braking, corresponding to outputs from layers 1,2 of >0.0 and <0.0 respectively. After application of the traction or braking control level split a check is carried out to see if the recommended power or braking level is retained, if not, the split proportions are overridden to ensure either adequate traction or braking forces are applied.

Figure 3:
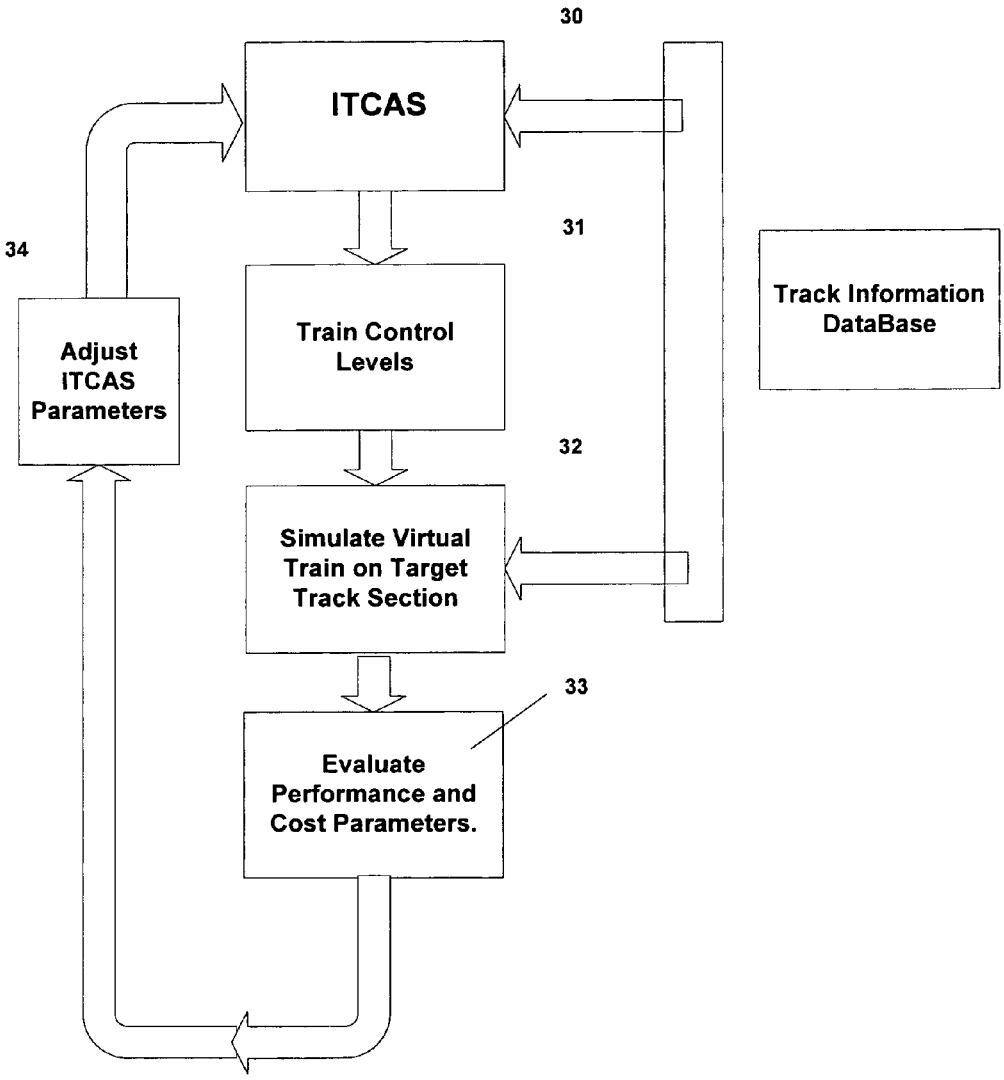
FIG. 3 is a flow diagram of the simulation system which is used to tune parameters for the target train-track system.

The outputs from Layers 1, 2 and 3 are combined in the Fuzzy Controller Output Unit 21 using weighting and 'winner-take-all' rules. The output from this unit 21 provides a level between −2.0 and 1.0 that is translated into train control settings in the Driving Rules Module 22. The translation of a level 1.0 to 100% power is straightforward. The rate at which power is added can be set in this module to suit railway owner practice and training policies. A slow application of power is desired to minimise inter-wagon dynamic impacts. Different rates are often required for more severe topographies and it will be possible for technicians to tune these parameters to suit the operating conditions. For retardation, maximum braking effort of 100% is applied for levels <=−1.0. The application of retardation forces using either dynamic braking or air brakes or both offers several choices. It is known that railway owners differ in their convictions as to what pertains to best practice and different techniques are often required due to curve/grade combinations and/or train loading mix. The driving rules module 22 provides the railway owner the opportunity to embed these policies and rules in the system and thereby advise or enforce these practices in the field. What constitutes best practice for an individual train-wagon-track system can be predetermined by using the fuzzy logic and driving rules modules to control full trip train simulations (FIG. 3).

If Distance-to-Go train traffic signaling information is available in the operators cabin, this information can be superimposed on top of the normal speed restrictions applicable and allows the system to provide control levels suitable for compliance with signals. A red or stop signal, for example, would over-ride existing speed restriction at that point and force the speed restriction level to zero. The system would then provide control levels to bring the train to a halt using optimal smooth deceleration and braking. Another scenario is where the policy of 90% running speed is imposed by the existence of an amber or caution signal. Again, the new speed restriction requirement would override existing speed restriction and apply the new restriction until either the signal returned to green or the train moved beyond the track section protected by that signal. Working without distance-to-go signaling would be implemented either as simulation control, driver advice or cruise control. Working with distance-to-go signaling would be implemented either as simulation control, driver advice or automatic pilot.

The outputs from the driving rules module 22 actuate the train control levels 23 by controlling throttle controls and brake controls. The results of controlling train levels can be displayed as driver advice 24 on instrument panels or provide a cruise control 25 or autopilot 26. Without future track signal information ITCAS can provide a cruise control so that the driver can take back control at frequent intervals to adjust for unexpected signal conditions. If the future track signal information is also processed and analyzed, ITCAS can provide autopilot control.

It is always desirable to optimize several parameters of train operation simultaneously. Such parameters will usually reflect a combination of requirements for safety, damage and wear minimization, energy minimization and running to schedule. A typical list of such parameters are given in Table 3. The issue of tuning the parameters contained in the fuzzy sets and the driving rules module can be addressed in a number of ways. Using the ITCAS system three methods including estimation by experts, tuning using simulation, tuning using mathematical algorithms can be employed (see FIG. 4).

Estimation by experts requires intricate and detailed knowledge of train operation and fuzzy mathematics. The fuzzy system parameters are set then tested with final adjustments in the field. Tuning using simulation uses the fuzzy system as a controller for the simulation of the train to be optimized as shown in FIG. 3. ITCAS 30 is used to provide control levels 31 to a simulation of the train 32. The results from these simulations can be evaluated 33 and then used as a basis to adjust the ITCAS parameters 34. The track database used is the same as that for the real train.

As the fuzzy system and filters representing good driving practice provide control levels outputs these outputs can be used to control train simulation. The functionality made available allows train simulations to be completed over many hundreds of kilometers of virtual track without user input. Using the system in this way allows the following:

Development of optimal fuzzy rules for the particular track topography.

Development and/or revision of good driving practice rules.

Multi-objective optimisation studies (see below)

Comparative simulations of different train configurations for studies in fatigue, energy usage, derailment safety and train punctuality.

Tuning using mathematical algorithms involves developing multivariable cost functions that correspond to the rail owners' business objectives. A typical optimization using genetic algorithms would allow weighted optimization to be completed. An example of a weighting scheme is included in Table 9. The simulation is repeatedly re-run with different ITCAS parameters which are developed using evolutionary computing principles based on the fitness-for-purpose of previous solutions. This process continues until the cost function is sufficiently minimised. The optimization achieved will be closest to optimal for the track route included and the driving rules that were used. It will also give near optimal results for similar track routes and driving rule sets. The parameters in the driving rules module must be defined and set before optimization of the fuzzy sets have started. These rules provide the operational practice constraints. Driving rules will typically include:

Limiting rates of power application.

Limiting rates of dynamic brake application

Limiting control disturbances

Minimum time between power and dynamic brake applications. Selection of braking method either dynamic braking or pneumatic braking Minimum brake pipe pressure drop when applying pneumatic train brakes Selection of braking method either dynamic braking or pneumatic braking Situations where dynamic braking and pneumatic braking can be combined Situations requiring emergency brake application.

The system can also be used in conjunction with other systems such as the Intelligent Train State Prediction System (ITSPS) which is a vehicle dynamic prediction system. Combining these systems allows the implementation of the ITCAS as a driver advisory system by giving the driver information to optimize train operation in the imminent future (FIG. 6). ITSPS provides predicted train velocity information for the next 50 seconds in future time and is updated in real time. The future velocity prediction from ITSPS is developed from an assumed control input profile, e.g. Throttle constant, Throttle increasing, Dynamic braking constant . . . etc, etc. An extremely useful control input profile that can be used is the most frequently deployed (obtained from data logging) and/or recommended profile for that train on that track position. The output from ITCAS provides a new control profile. The advised control parameters can then be fed back to ITSPS and the driver can be informed of impending train dynamics if the ITCAS advice is deployed. A further variation shown in FIG. 7 is provided by the capability of using the output from the ITCAS to be automatically fed back into the ITSPS to provide train velocity and in-train force predictions to be displayed that correspond to the output advice from ITCAS.

EXAMPLE 1

Calculations for Operating the Control System for Controlling the Dynamics and Energy Consumption of Long Vehicles 1. Calculation of the Train Position:

The train position is calculated using the last GPS track datum and locomotive velocity data. GPS readings are taken at a rate of approximately 1 record per second. The train position is determined by using two GPS readings either side of a known GPS datum point which corresponds to a known linear track distance, and calculating the distance between the GPS readings and the GPS datum thereby determining train position at the time and place of the GPS reading. The data from locomotive velocity transducers is then integrated to give the distance traveled since passing the GPS position update.

$$X = R[(Lat_{GPS(1)} - Lat_{GPS(datum)})^2 + (Long_{GPS(1)} - Long_{GPS(datum)})^2]^{1/2} + \sum_{n=0}^{n=N} V.\Delta t$$

Where GPS(1) is the first GPS reading past the known GPS datum and R is the Radius of the earth.

Track Position and related track data is then determined by interpolating the track database for X. datum. The track database consists of typical track plan and section data with data fields for Linear Distance, Grade or Elevation, Radius or Curvature and Survey Pegs. The database may also include speed restriction information.

2. Cruise Control Calculations (Layer1)

a. Grade Calculations

A selection is required as to how much track ahead of the train is included in the control system calculations. Track with numerous very steep grades will be better served by shorter future track sections, while much longer sections will be workable on flatter topography. It is also sensible to make this distance proportional to running speed, hence specified in running time. For this example the selected future track sections be represented by 50 and 200 seconds running time. Present running speed is 40 kph Track Distance Zone 1=40 kph/3.6*200 s=2.222 km Track Distance Zone 2=40 kph/3.6*50 s=0.555 km Track sections under the train for a distributed power train of 102 wagons (length 14 m), and 4 locomotives (length 20 m) are given by:

Track Distance Zone 3=2*20 m+51*14 m=0.754 km

Track Distance Zone 4=2*20 m+51*14 m=0.754 km

For the track site described by the linear distance of 56.4 km and traveling along the track database in the direction of increasing kilometers, the track zones for analysis are:

Track Distance Zone 1: 56.4 to 58.62 km

Track Distance Zone 2: 56.4 to 56.95 km

Track Distance Zone 3: 55.65 to 56.4 km

Track Distance Zone 4: 54.89 to 55.65 km

The linear distances are used to interpolate a track elevation database. The following data is obtained.

| Track Distance (km) | Elevation (m) |
|---|---|
| 58.62 | 10.0 |
| 56.95 | 13.0 |
| 56.4 | 18.0 |
| 55.65 | 12.0 |
| 54.89 | 5.0 |

Net Grades in Track Zones are therefore

| Zone | Grade |
|---|---|
| 1 | $= \frac{(10-18)*100}{(58.62-56.4)*1000} = -0.36\%$ |
| 2 | $= \frac{(13-18)*100}{(56.95-56.4)*1000} = -0.91\%$ |
| 3 | $= \frac{(18-12)*100}{(56.4-55.65)*1000} = +0.80\%$ |
| 4 | $= \frac{(12-5)*100}{(56.4-54.89)*1000} = +0.46\%$ |

b. Velocity Error Calculation

Assuming a target velocity of 55 kph.

The Velocity Error=−15 kph c. Fuzzy Calculation

The fuzzy rules are applied using the product rule. Fuzzy set memberships are calculated using triangular membership functions. The median values of the triangular membership functions are given in the title rows and columns of the fuzzy set tables, e.g. Table 2. The upper and lower bounds of the triangular membership functions are a simple implementation can be the medians of the membership functions defined by the columns or rows either side. (These bounds can also be tuned to refine control characteristics.) For example, the triangular membership function for the grade of Grade=−0.5% is given by the limits, lower limit=−1.0%, Median=−0.5%, upper limit=0.0%. For this example part of the Table 2 is given by:

| Values Used - Extracted from Table 2 | | |
|---|---|---|
| | Grade: −0.5% | Grade: 0.0% |
| Vel. Error: −20 kph | 0.6 | 0.8 |
| Vel. Error: −10 kph | 0.2 | 0.6 |

Calculating just Zone1.

The Velocity Error due to present train speed has a membership in two fuzzy sets:

Velocity Error=−20 kph, Membership=0.5 (50%)

Velocity Error=−10 kph, Membership=0.5 (50%)

The grade in Zone 1 likewise has memberships of:

Grade=0.0%, Membership=0.28 (28%)

Grade=−0.5%, Membership=0.72 (72%)

The fuzzy output is obtained by multiplying the membership levels by the values in the fuzzy table and then adding all the results.

$$frsov1=0.5*0.72*0.6+0.5*0.28*0.8+0.5*0.72*0.2+0.5*0.28*0.6=0.484$$

This process of calculation is repeated 3 further times to obtain frsov2, frsov3 and frsov4. The final output being calculated by either:

$$\text{Output_Layer\#1}=\text{MAX}\ (frsov1, frsov2, frsov3, frsov4)\ \text{i.e. 'winner-take-all'}$$

$$\text{Output_Layer\#1}=(w1*frsov1+w2*frsov2+w3*frsov3+w4*frsov4)/(w1+w2+w3+w4)$$

Weights w1, w2, w3, and w4 are chosen as values between 0 and 1.0. For understanding track and severe grades best results are usually obtained using the 'winner-take-all' calculations. For optimized train track systems with reduced grades and higher speed permissions on curves the weighted calculation can be used to achieve higher levels of energy optimization.

3. Speed Restriction Control Calculations (Layer 2)

The calculation for speed restriction utilizes the same future track zones but only track zone for under the train. The zones in this example are as follows:

Track Distance Zone 1: 56.4 to 58.62 km

Track Distance Zone 2: 56.4 to 56.95 km

Track Distance Zone 3: 54.89 to 56.4 km

The Speed Restriction Information in these zones are found by interpolating the speed restriction data base for the track section. The speed restrictions in this example as shown in the following table:

| Zone | Speed Restriction Information (kph) | Starting at (km) | End at (km) |
|---|---|---|---|
| 1 | 40.0 | 58.0 | 58.4 |
| | 30.0 | 58.4 | >58.62 |
| 2 | 30.0 | 56.6 | 56.95 |
| | 60.0 | 56.95 | 58.0 |
| 3 | 60.0 | <54.89 | 56.6 |

The speed restriction information is then used to calculate the deceleration requirements. For track Zone#1 the Maximum Deceleration requirement was calculated at(30-40)(58.4-56.4)=−5 kph per km. The Maximum Deceleration requirement occurs at Distance 58.4 km, or 2 km in front of the train. The fuzzy output is again obtained by multiplying the membership levels by the values in the fuzzy table and then adding all the results. The fuzzy rule set output value (frsov) is then, using values relevant to this calculation from Table 4. The relevant part of table 4 is:

| Values Used - Extracted from Table 4 | |
|---|---|
| | Distance: 2000 m |
| Vel Reduction: −20 kph | −0.25 |
| Vel Reduction: 0 kph | 0 |

The Velocity Reduction in Zone 1 likewise has memberships of:

Velocity Error=−20 kph, Membership=0.5 (50%)

Velocity Error=0 kph, Membership=0.5 (50%)

The Distance in Zone 1 likewise has memberships of:
Distance: 1000 m, Membership=0.0 (0%)
Distance: 2000 m, Membership=1.0 (100%)
Distance: 4000 m, Membership=0.0 (0%)

$$frsov1=0.5*1.0*(-0.25)+0.5*1.0*0.0=-0.125$$

This process of calculation is repeated 3 further times to obtain frsov2, frsov3 and frsov4. The final output being calculated by taking the lowest value.

$$\text{Output_Layer\#2}=\text{MIN}(frsov1, frsov2, frsov3, frsov4)$$
i.e. 'winner-take-all'

The output for the fuzzy controller is then simply obtained by adding the outputs of Output_Layer#1 and Output_Layer#2. Fuzzy controller Output=Output_Layer#1+Output_Layer#2

If the value of (Fuzzy controller Output) is less than −1.0, the value is simply truncated to −1.0.

4. Control Policy Filters

The fuzzy controller has now provided an output between −1.0 and +1.0. This value must now be translated into vehicle control parameters. Values 0 to +1.0 translate into power settings, values −1.0 to 0 translate into brake settings. The exact way in which this translation is done depends on the control policy filters. These are located in the Driving Rules Database Software (22). These filters will depend on the rules that are relevant to the train-track system and will also depend on rail operator preferences. These filters will not only set levels and combinations of controls but also the rates at which controls are changed.

Examples are:

a. Throttle adjustments are only allowed at a certain rate, e.g. 1.4% per second
b. Dynamic brake applications rates allowed at 5% per second
c. Minimum of 10 seconds between throttle and dynamic brake change overs
d. Minimum first brake pipe reduction is 50 kPa
e. Brake pipe reductions must be maintained for 30 seconds.

EXAMPLE 2

Additional Calculations for Power Splitting for Operating the Control System for Controlling the Dynamics and Energy Consumption of Long Vehicles with Distributed Power These calculations apply only to Layer 3 and are only added for distributed power trains. Layer 3 takes the net output from Layers 1 and 2 and allocates differing proportions of this output to different locomotive groups. For example if the net output from Layers 1 and 2 was +0.3. Note the train is under power. If the following hypothetical example of a track crest under the train is considered with elevation data as:

| Train Position | Track Distance (km) | Elevation (m) |
|---|---|---|
| Lead 1st Rack | 56.4 | 7.0 |
| Tail 1st Rack | 55.65 | 12.0 |
| Lead 2nd Rack | 55.65 | 12.0 |
| Tail 2nd Rack | 54.89 | 5.0 |

The grades are:

| Grade | Grade |
|---|---|
| #1 | $= \frac{(7-12)*100}{(56.4-55.65)*1000} = -0.67\%$ |
| #2 | $= \frac{(12-5)*100}{(56.4-54.89)*1000} = +0.46\%$ |

The relevant part of the fuzzy rule table is:

| Values Used - Extracted from Table 6 | | |
|---|---|---|
| | Grade#1: −1.0 | Grade#1: −0.5 |
| Grade#2: 0.0 | {0.5, 1} | {0.75, 1} |
| Grade#2: +0.5 | {0.25, 1} | {0.5, 1} |

The relevant memberships are:
Grade#1: −1.0, Membership=0.34 (34%)
Grade#1: −0.5, Membership=0.66 (66%)
Grade#2: 0.0, Membership=0.08 (8%)
Grade#2: +0.5, Membership=0.92 (92%)

$$frsov1=0.34*0.08*\{0.5,1\}+0.34*0.92*\{0.25,1\}+0.66*0.08*\{0.75,1\}+0.66*0.92*\{0.5,1\}.$$

Splitting into Lead and Remote Levels $$frsov1_Lead=0.34*0.08*0.5+0.34*0.92*0.25+0.66*0.08*0.75+0.66*0.92*0.5=0.435$$

$$frsov1_Remote=0.34*0.08*1+0.34*0.92*1.0+0.66*0.08*1.0+0.66*0.92*1.0=1.0$$

Relative Levels are:
Lead Locomotive Group Setting=0.435/(1.435)*0.3*2=0.18
Remote Locomotive Group Setting=1.0/(1.435)*0.3*2=0.42
Note that the average power applied is still +0.3.

The advantages of the present invention include providing a system and method for optimizing the train dynamics and energy usage of freight trains by determining the train's operating conditions and calculating an optimal sequence of power and braking control actions. The sequence calculated provides for optimal vehicle dynamic behaviour with minimum energy usage in accordance with the train type, track topography and train operation rules and policies. Optimization can be generic or more finely tuned to maximize benefits of purpose built, unit train, heavy haul railway systems. The optimized parameters and operational rules and policies are pre-embedded in the system memory. The optimization can also reflect business situation changes allowing for different balances to be struck between cost demands of running to schedule, maintenance costs and energy usage minimization. The method offers either a scenario management tool for the driver or reference signals for a train cruise control or autopilot system.

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

TABLE 1

Fuzzy Rules for Grade-Speed Cruise Control Module

| | Grade: −Large | Grade: −Medium | Grade: Level | Grade: +Medium | Grade: +Large |
|---|---|---|---|---|---|
| Vel. Error: −Large | V_Small | Small | Medium | M_Large | Large |
| Vel. Error: −Medium | Zero | V_Small | Small | Medium | M_Large |
| Vel. Error: Nil | −Small | Zero | V_Small | Small | Medium |
| Vel. Error: +Medium | −Medium | −Small | Zero | V_Small | Small |
| Vel. Error: +Large | −Large | −Medium | −Small | Zero | V_Small |

TABLE 2

Example Values of the Fuzzy Rules for Grade-Speed Cruise Control Module

| | Grade: −1.0% | Grade: −0.5% | Grade: 0.0% | Grade: +0.5% | Grade: +1.0% |
|---|---|---|---|---|---|
| Vel. Error: −20 kph | 0.2 | 0.6 | 0.8 | 1 | 1 |
| Vel. Error: −10 kph | 0 | 0.2 | 0.6 | 0.8 | 1 |
| Vel. Error: 0 kph | −0.25 | 0 | 0.2 | 0.6 | 0.8 |
| Vel. Error: +10 kph | −0.5 | −0.25 | 0 | 0.2 | 0.6 |
| Vel. Error: +20 kph | −1 | −0.5 | −0.25 | 0 | 0.2 |

TABLE 3

Fuzzy Rules for Speed Restriction Cruise Control Module

| | Distance: Immanent | Distance: Near | Distance: Medium | Distance: Far | Distance: V_Far |
|---|---|---|---|---|---|
| Vel. Reduction: −V Large | −V_Large | −Large | −Medium | −Small | −V_Small |
| Vel. Reduction: −Large | −Large | −Medium | −Small | −V_Small | −V_Small |
| Vel. Reduction: −Medium | −Medium | −Small | −V_Small | −V_Small | −VV_Small |
| Vel. Reduction: −Small | −Small | −V_Small | −V_Small | −VV_Small | Zero |
| Vel. Reduction: Nil | Zero | Zero | Zero | Zero | Zero |

TABLE 4

Example values of Fuzzy Rules for Speed Restriction Cruise Control Module

| | Distance: 0 m | Distance: 500 m | Distance: 1000 m | Distance: 2000 m | Distance: 4000 m |
|---|---|---|---|---|---|
| Vel. Reduction: −80 kph | −2 | −2 | −2 | −2 | −1.5 |

TABLE 4-continued

Example values of Fuzzy Rules for Speed Restriction Cruise Control Module

| | Distance: 0 m | Distance: 500 m | Distance: 1000 m | Distance: 2000 m | Distance: 4000 m |
|---|---|---|---|---|---|
| Vel. Reduction: −60 kph | −2 | −2 | −2 | −1.5 | −1 |
| Vel. Reduction: −40 kph | −2 | −2 | −1.5 | −1 | −0.25 |
| Vel. Reduction: −20 kph | −2 | −1.5 | −1 | −0.25 | −0.1 |

TABLE 4-continued

Example values of Fuzzy Rules for Speed Restriction Cruise Control Module

| | Distance: 0 m | Distance: 500 m | Distance: 1000 m | Distance: 2000 m | Distance: 4000 m |
|---|---|---|---|---|---|
| Vel. Reduction: 0 kph | 0 | 0 | 0 | 0 | 0 |

TABLE 5

Fuzzy Rules for Traction Splitting for Distributed Power Trains

| | Grade#1: −Large | Grade#1: −Medium | Grade#1: Level | Grade#1: +Medium | Grade#1: +Large |
|---|---|---|---|---|---|
| Grade#2: −Large | {LM, RM} | {LM, Rh} | {LM, Rm} | {LM, Rs} | {LM, Rz} |
| Grade#2: −Medium | {Lh, RM} | {LM, RM} | {LM, Rh} | {LM, Rm} | {LM, Rs} |
| Grade#2: Level | {Lm, RM} | {Lh, RM} | {LM, RM} | {LM, Rh} | {LM, Rm} |
| Grade#2: +Medium | {Ls, RM} | {Lm, RM} | {Lh, RM} | {LM, RM} | {LM, Rh} |
| Grade#2: +Large | {Lz, RM} | {Ls, RM} | {Lm, RM} | {Lh, RM} | {LM, RM} |

TABLE 6

Fuzzy Rules for Retardation Splitting for Distributed Power Trains

| | Grade#1: −Large | Grade#1: −Medium | Grade#1: Level | Grade#1: +Medium | Grade#1: +Large |
|---|---|---|---|---|---|
| Grade#2: −Large | {LM, RM} | {Lh, RM} | {Lm, RM} | {Ls, RM} | {Lz, RM} |
| Grade#2: −Medium | {LM, Rh} | {LM, RM} | {Lh, RM} | {Lm, RM} | {Ls, RM} |
| Grade#2: Level | {LM, Rm} | {LM, Rh} | {LM, RM} | {Lh, RM} | {Lm, RM} |
| Grade#2: +Medium | {LM, Rs} | {LM, Rm} | {LM, Rh} | {LM, RM} | {Lh, RM} |
| Grade#2: +Large | {LM, Rz} | {LM, Rs} | {LM, Rm} | {LM, Rh} | {LM, RM} |

Legend:
Grade#1 = Net Grade under First Wagon Rack
Grade#2 = Net Grade under Second Wagon Rack
L = Apply Level Lead Locomotive Group
R = Apply Level Remote Locomotive Group
M = Maximum
h = High
m = Medium
s = Small
z = Zero or close to zero

TABLE 7

Example Values of Fuzzy Rules for Traction Splitting for Distributed Power Trains

| | Grade#1: −Large | Grade#1: −Medium | Grade#1: Level | Grade#1: +Medium | Grade#1: +Large |
|---|---|---|---|---|---|
| Grade#2: −Large | {1, 1} | {1, 0.75} | {1, 0.5} | {1, 0.25} | {1, 0} |
| Grade#2: −Medium | {0.75, 1} | {1, 1} | {1, 0.75} | {1, 0.5} | {1, 0.25} |
| Grade#2: Level | {0.5, 1} | {0.75, 1} | {1, 1} | {1, 0.75} | {1, 0.5} |
| Grade#2: +Medium | {0.25, 1} | {0.5, 1} | {0.75, 1} | {1, 1} | {1, 0.75} |
| Grade#2: +Large | {0, 1} | {0.25, 1} | {0.5, 1} | {0.75, 1} | {1, 1} |

TABLE 8

Example values of the Fuzzy Rules for Retardation Splitting for Distributed Power Trains

| | Grade#1: −Large | Grade#1: −Medium | Grade#1: Level | Grade#1: +Medium | Grade#1: +Large |
|---|---|---|---|---|---|
| Grade#2: −Large | {1, 1} | {0.75, 1} | {0.5, 1} | {0.25, 1} | {0, 1} |
| Grade#2: −Medium | {1, 0.75} | {1, 1} | {0.75, 1} | {0.5, 1} | {0.25, 1} |
| Grade#2: Level | {1, 0.5} | {1, 0.75} | {1, 1} | {0.75, 1} | {0.5, 1} |
| Grade#2: +Medium | {1, 0.25} | {1, 0.5} | {1, 0.75} | {1, 1} | {0.75, 1} |
| Grade#2: +Large | {1, 0} | {1, 0.25} | {1, 0.5} | {1, 0.75} | {1, 1} |

TABLE 9

Example of Train Trip Performance Cost Function Optimisation Weights

| Index | Description | Weights |
|---|---|---|
| 0 | Speed Violations, kph.seconds | 0.09 |
| 1 | Max Tensile Force | 0.03 |
| 2 | Max Compression Force | 0.03 |
| 3 | Force RMS | 0.03 |
| 4 | Acceleration RMS | 0.06 |
| 5 | Energy Used F.d when Notch > 0 | 0.09 |
| 6 | Trip Time Minimum | 0.09 |
| 7 | Destination Reached (Mission Success) | 0.58 |

The invention claimed is:

1. A method for controlling the dynamics and energy consumption of a train during operation comprising receiving input signals from input means;

processing input signals using algorithmic analysis with fuzzy logic control software, said fuzzy logic control software processes the input signals in relation to (a) grade topography cruise control and calculates the power and braking requirements for track in the far future zone, track in the future zone, track under the first half of the train zone and track under the second half of the train zone, the power and braking requirements for all four zones are combined to form a layer 1 output; (b) speed restriction enforcer and calculates the value and positions of speed restrictions for track in the far future zone, track in the future zone, track under the train zone, the results from the three zones are combined to form a layer 2 output; (c) throttle braking splitter and calculates the different amounts of power and braking required for distributed power trains and forming layer 3 output; and combining the layer 1 output, the layer 2 output and the layer 3 output to form a combined output, said combined output being processed through a driving rules module to provide train control settings, wherein said driving rules module sets parameter levels, combinations of control parameters and regulates the acceleration and braking rates.

2. A method as claimed in claim 1 wherein the train position is calculated using GPS track datum and locomotive velocity data.

3. A method as claimed in claim 1 wherein grade information for the grade topography cruise control is calculated from the track length in each zone and velocity difference between the actual running speed and target running speed.

4. A method as claimed in claim 1 wherein the input means includes transducer inputs from proximal and remotely positioned driving units such as locomotives, inputs from global positioning system (GPS) providing position information, telemetry inputs providing current and future signals, inputs from track information database providing information about the track under and ahead of the train.

5. A method as claimed in claim 1 wherein distance-to-go train traffic signaling information is superimposed over the train control settings to provide control levels that allow compliance with the signaling information.

* * * * *